United States Patent [19]

Harrington et al.

[11] 3,993,314

[45] Nov. 23, 1976

[54] GOLF CLUB

[75] Inventors: Lance E. Harrington, Westlake; Thomas Lisa, Studio City, both of Calif.

[73] Assignee: Thomas Lisa, Studio City, Calif.

[22] Filed: Mar. 17, 1975

[21] Appl. No.: 559,320

[52] U.S. Cl. ..... 273/170

[51] Int. Cl.[2] ..... A63B 53/08

[58] Field of Search ..... 273/77 R, 80 R, 80 B, 273/167 R, 167 F, 167 H, 167 J, 169, 170, 171, 78, 73 R, 73 C, 73 J; 145/29 R, 29 A–29 D

[56] References Cited

UNITED STATES PATENTS

| | | | |
|---|---|---|---|
| 556,043 | 3/1896 | Briggs | 273/169 X |
| 1,524,488 | 1/1925 | Read | 273/169 |
| 1,548,068 | 8/1925 | Sullivan | 273/167 H X |
| 1,561,595 | 11/1925 | Davis | 273/170 |
| 1,831,255 | 11/1931 | Menzies | 273/80 B X |
| 1,894,841 | 1/1933 | Adams | 273/170 |
| 3,037,775 | 6/1962 | Busch | 273/170 X |
| 3,516,673 | 6/1970 | Estes | 273/170 X |
| 3,652,093 | 3/1972 | Reuter | 273/167 F X |
| 3,817,522 | 6/1974 | Simmons | 273/78 |
| 3,843,135 | 10/1974 | Andrews | 273/170 |

FOREIGN PATENTS OR APPLICATIONS

| | | | |
|---|---|---|---|
| 15,733 | 12/1933 | Australia | 273/170 |
| 4,784 | 3/1908 | United Kingdom | 273/170 |
| 448,561 | 6/1936 | United Kingdom | 273/170 |

*Primary Examiner*—Richard J. Apley
*Attorney, Agent, or Firm*—Flam & Flam

[57] ABSTRACT

A golf club such as a driver has a two-part sealed cavity. One of the parts extends a limited length along the lower end of the shaft. The other of the parts is of generally flattened teardrop configuration aligned with the shaft axis and located generally vertically in the address position of the club. A pool of mercury partially fills the cavity, but is capable of substantially filling the cavity part located in the club head. The cavity is lined or layered with antifriction material to facilitate flow. A laterally open groove at the top of the flattened teardrop cavity part ensures free flow of mercury.

8 Claims, 7 Drawing Figures

GOLF CLUB

FIELD OF INVENTION

This invention relates to golf clubs, and more particularly to golf clubs utilizing a shifting weight for the purpose of transmitting increased driving force through the club face.

DISCUSSION OF PRIOR ART

U.S. Pat. No. 3,516,673 issued to a Sanford A. Estes shows and describes a shifting weight golf club in which a volume of mercury forms the shifting weight. During the backswing, the mercury flows into the golf club shank. At the moment of impact, the mercury returns to a recess in the club by centripedal force. The principle is theoretically sound, having been previously used in sledge hammers and other driving tools. In a golf club, the action of the moving mercury must be predictable and hence uniform. The Estes design does not consider the flow dynamics of mercury. Pools may separate due to sharp corners, etc. The action may change from swing to swing notwithstanding all other variables being held constant.

Also, in order to move the mercury between the shaft and the head cavity, air must be displaced. The surface tension of the interacting air and mercury fluids prevents uniform flow through the narrow channels. Estes proposes to solve that problem by subjecting the cavity to a vacuum. The seals must withstand high changing stresses. Thus Estes has the problem of finding suitable flexible sealing materials.

The primary object of this invention is to provide a consistent shifting weight golf club that is free of the foregoing disadvantages.

SUMMARY OF THE INVENTION

In order to accomplish the foregoing objective, I provide a flow cavity including a club head recess and only a portion of the golf club shaft for shifting movement. The cavity is streamlined or tearshaped in order to ensure uniformity of flow. At the same time, the cavity is sealed, but at nominal atmospheric pressure. The thermal expansion of the mercury is retarded by the higher partial gas pressure. Preferably the gas is nitrogen or other inert gas. The cavity is coated or lined with an antifriction material such as Teflon or Varithane. To ensure flow rather than bubbling, a vent channel is formed for purposes of equalizing the pressure. The pool smoothly flows as a unit and the theoretical advantages of the shifting weight are achieved with consistency.

BRIEF DESCRIPTION OF THE DRAWINGS

A detailed description of the invention will be made with reference to the accompanying drawings wherein like numerals designate corresponding parts in the several figures. These drawings unless otherwise indicated are to scale.

DETAILED DESCRIPTION OF THE DRAWINGS

Figure 1:
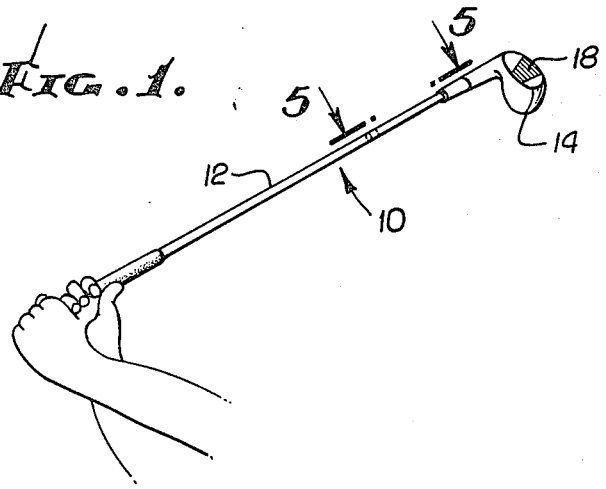
FIG. 1 is a pictorial view showing a golf club incorporating my invention showing the club in its full backswing position.

The following detailed description is of the best presently contemplated modes of carrying out the invention. This description is not to be taken in a limiting sense, but is made merely for the purpose of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

The golf club 10 includes a conventional shaft 12 and a wood club head 14, the head 14 having a hollow shank 16 that receives the end of the shaft 12 in a conventional manner. The golf club head 14 has a conventional external configuration including a club face 18. In the present instance a No. 1 driver is illustrated with its characteristic face angularity. The present invention is primarily applicable to this club where distance of drive is ordinarily the primary consideration. The design may also be used with other clubs either to reduce the effort required or to balance the action of a set of clubs.

Figure 4:
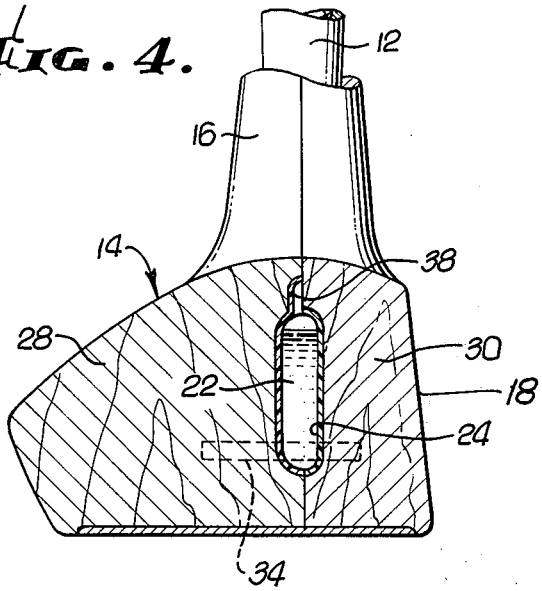
FIG. 4 is a transverse sectional view of the club head.

The club head 14 in the present instance carries a sliding or shifting weight in the form of a pool 22 of mercury. The pool 22 partially occupies a cavity consisting of two parts. One part is a generally flattened teardrop recess 24 (see also FIG. 4) formed in the club head behind the face 18. The second part is the adjoining plastic tube 26 that extends through the club head shank 16 and partially into the shaft 12.

Figure 3:
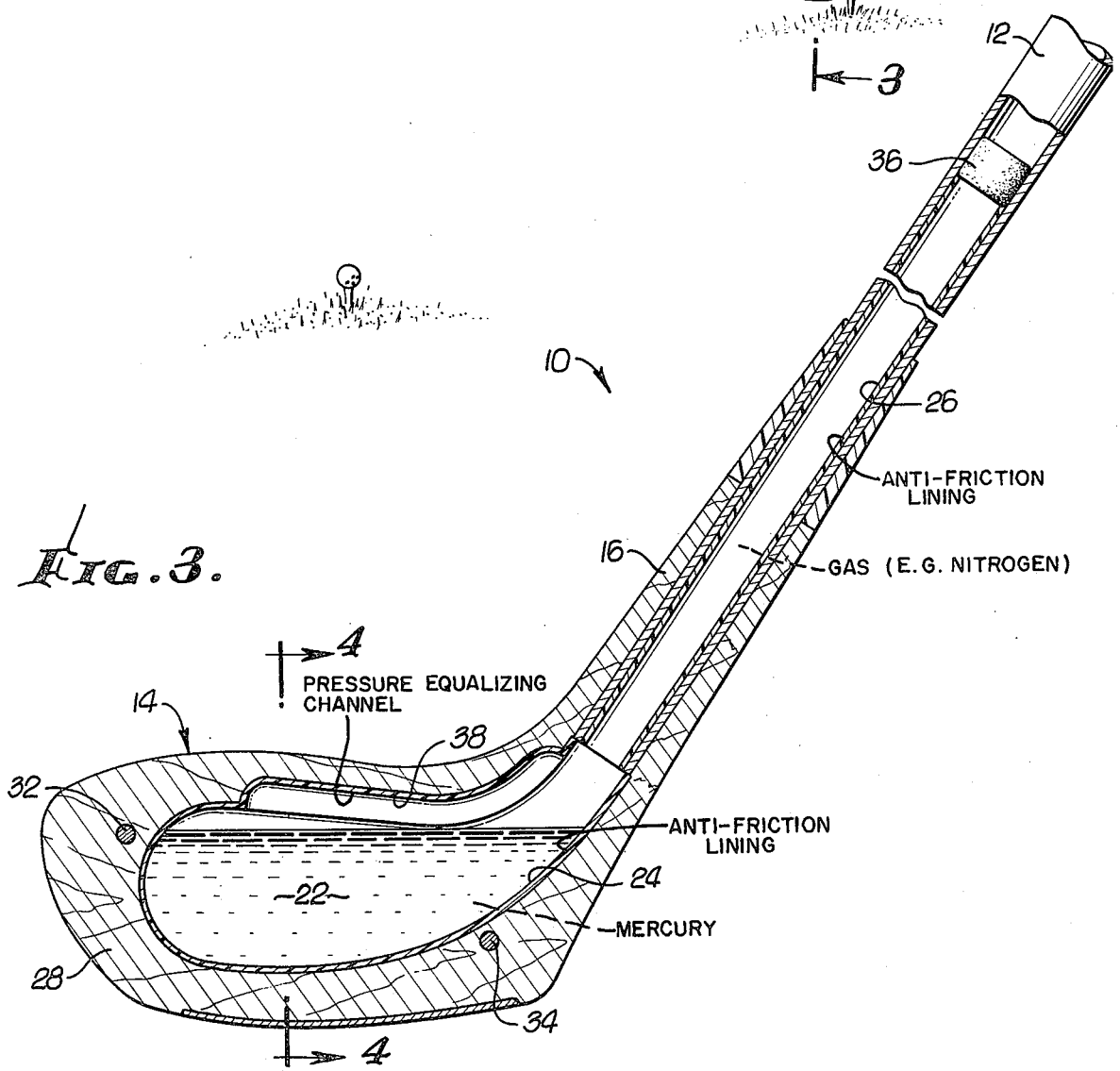
FIG. 3 is an enlarged fragmentary sectional view taken along the shaft axis behind the club face and as indicated by line 3—3 of FIG. 2.

The recess 24 is formed between complimentary halves 28 and 30 of the club head which are held together by dowels 32 and 34. (See also FIG. 6.) The recess 24 and the adjoining recess 24 preferably have antifriction characteristics in order to ensure smooth prompt flow of the mercury pool between parts of the cavity. For this purpose the recess 24 is sprayed with a product known commercially as Varithane. Alternatively, a molded plastic liner could be formed made, for example, of material such as Teflon. The shaft liner 26 is likewise made of plastic material which, in addition to providing suitable antifriction flow characteristics, protects the steel shaft from the corrosive effects of mercury. The upper end of the shaft liner is closed by a stopper 36 (FIG. 3) to define the upper extent of the cavity.

Figure 2:
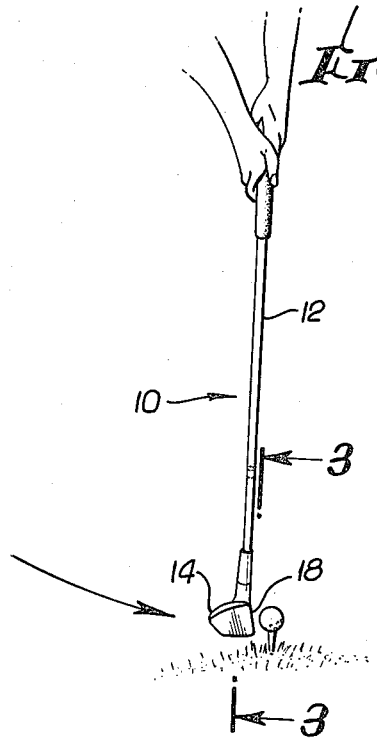
FIG. 2 is a similar view, but showing the club head as it is about to strike the ball.
Figure 5:
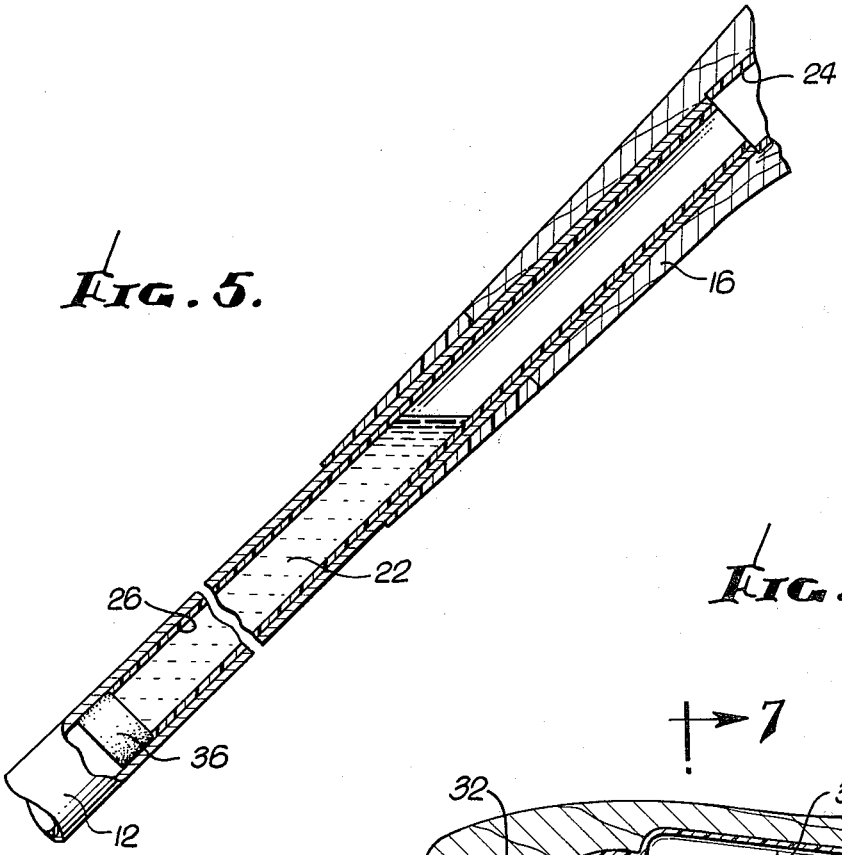
FIG. 5 is an enlarged fragmentary sectional view taken along the plane indicated by line 5—5 of FIG. 1 and showing the shifted weight at the backswing position.

The mercury pool 22 has essentially two alternate positions in the cavity corresponding to the backswing position of FIG. 1 and the strike position of FIG. 2. In the backswing position, the mercury pool moves into the shaft liner 26 as shown in FIG. 5. As the club begins its travel, the mercury moves radially outwardly from the club handle toward the club head and into the recess 24. At the moment of impact, the entire body of mercury has just arrived in position behind the club face. The kinetic energy of the moving mercury pool is transferred to the ball to provide increased impact and drive.

The cavity is totally sealed at its joints preferably by a thermosetting resin such as epoxy. The cavity is sealed at atmospheric pressure and no undue stress is placed upon the sealed joints by any pressure differential. By virtue of the seal, the thermal expansion of the mercury pool is limited whereby the variation of the club feel is minimized due to temperature differences. Preferably the cavity is sealed with nitrogen or other inert gas.

To ensure that the mercury pool flows rather than drips as it flows, a pressure equalizing channel 38 is provided. The channel 38 in this instance is open. It extdends along the top of the recess 24. The channel 38 is sufficiently narrow such that surface tension keeps the mercury out of the channel. Accordingly, the channel 38 provides a passage for flow of the gas between the outer end of the club recess 24 and the shank end. The permitted transfer of gas prevents the buildup of pressure differentials that would block smooth fow. If desired, the channel could extend the entire length of the cavity including the tube 36. Optionally, a vent tube could be provided to form the channel.

Figure 7:
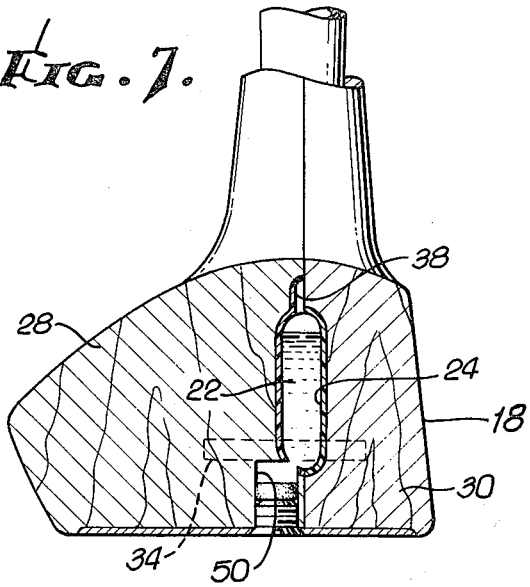
FIG. 7 is a transverse sectional view taken along a plane corresponding to line 7—7 of FIG. 6.
Figure 6:
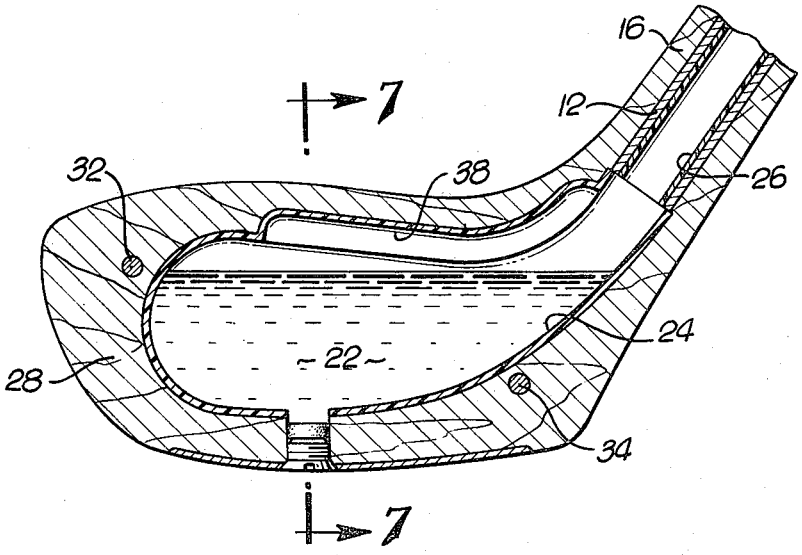
FIG. 6 is a sectional view similar to FIG. 3, but showing a modified form of the present invention.

In the form illustrated in FIGS. 6 and 7, a fill hole 50 is provided whereby the amount of mercury can be controlled or changed to compensate, for example, for the different climatic condtions or the personal desires of the user.

Intending to claim all novel, useful and unobvious features shown or described, we make the following claims:

1. A golf club having a head and a shaft; said head having a club face; means forming a sealed cavity having two communicating parts, one of the parts extending along a limited length of said shaft and the other of said parts being located behind and substantially centered at the club face; said cavity part having a flattened teardrop shape with an area that is a substantial fraction of that of the club face, said other cavity part generally paralleling said club face to extend in a substantially vertical plane when the golf club is in its addressed position, the neck of said teardrop cavity part registering with the said one cavity part with the said other cavity part aligned with the axis of the shaft; a pool of mercury only partially filling the cavity; a body of inert gas filling the remainder of said cavity and sealed therein; said other cavity part having a configuration to facilitate flow of mercury between the cavity parts as the club moves between back swing and ball striking positions; said pool of mercury substantially filling the said other cavity part when said golf club is in its addressed position.

2. The golf club as set forth in claim 1 in which said cavity is lined with anti-friction plastic material.

3. The golf club as set forth in claim 1 in which said other cavity part includes a groove extending along the top of said other cavity part for equalizing gas pressure between spaced portions of said cavity to ensure free flow of mercury therein, said groove having a limited access lateral opening extending along its entire length, said lateral opening being sufficiently narrow to exclude mercury therefrom without excluding gas.

4. The golf club as set forth in claim 1 together with a fill hole communicating with said other cavity part for controlling the volume and weight of mercury in the cavity.

5. The golf club as set forth in claim 1 together with means forming a groove along the top of said other cavity part to equalize gas pressure between ends of said cavity to ensure free flow of mercury, said groove having a limited lateral access opening extending along its entire length, said opening being sufficiently narrow to exclude mercury therefrom without excluding said gas.

6. A golf club:

a. said golf club having a head formed of mating halves and forming a flat recess generally parallel to and behind the face of the club;

said golf club having a hollow shaft fitted to the shank of the club and communicating with said recess;

c. means closing the hollow club shaft at a place spaced from the shank end thereof, and defining with the included hollow club shaft section and said recess, a sealed cavity;

d. a pool of mercury partially filling said sealed cavity;

e. a body of gas filling the remainder of said cavity;

f. said recess having a configuration to facilitate flow of mercury from the shaft to the recess and from the recess to the shaft as the club moves between back swing and ball striking positions.

7. The golf club as set forth in claim 6 in which said recess has a generally teardrop shape with the teardrop neck connecting with the shaft.

8. The golf club as set forth in claim 6 in which said cavity is lined with antifriction plastic material.

* * * * *